United States Patent [19]

Vanderminden

[11] Patent Number: 4,541,666

[45] Date of Patent: Sep. 17, 1985

[54] SAND CHAIR

[76] Inventor: Robert D. Vanderminden, Court St., Granville, N.Y. 12832

[21] Appl. No.: 500,872

[22] Filed: Jun. 3, 1983

[51] Int. Cl.[4] ..... A47C 4/00

[52] U.S. Cl. ..... 297/16; 297/31; 297/59; 297/445

[58] Field of Search ..... 297/16, 445, 463, 378, 297/379, 59, 448, 31, 41, 55, 310

[56] References Cited

U.S. PATENT DOCUMENTS 3,171,511 6/1964 Weil et al. ..... 297/59 X 4,323,260 4/1982 Suchy ..... 297/59 X

FOREIGN PATENT DOCUMENTS 102481 2/1956 Fed. Rep. of Germany ..... 297/445

*Primary Examiner*—Kenneth Downey

[57] ABSTRACT

The collapsible armless chair comprises a pivotally connected seat frame and a back frame which also define the leg supports. An arcuate-shaped projecting portion at the bottom of the back frame provides stability for the chair. The projecting portion is also angled upwardly relative to the ground plane. The user may lean back in the chair until the front leg support leaves the ground and rotate the chair right or left without rising from the chair.

22 Claims, 4 Drawing Figures

SAND CHAIR

This invention relates to a sand chair.

More particularly, this invention relates to an armless chair for beach or other outdoor use.

Heretofore, several types of armless chairs have been known for outdoor use such as at a beach or poolside. In some cases, the chairs have been of the back-rest variety which include a rather long seat and a shorter back of wooden slats. In these instances, the seat of the chair is usually raised only a short distance off the ground by wooden runners, thus enabling the user's legs to extend essentially horizontally in a restful position. However, this type of chair is heavy to carry and relatively expensive because of the wooden construction.

In other cases, armless chairs have been formed of lightweight metal tubing bent into two U-shaped members to form a seat frame and a back frame with a seat and back formed by a woven fabric or plastic material secured across each frame. This type of chair is usually light in weight and can be readily folded when not in use. However, this type of chair becomes unstable when the user leans back, particularly where the chair is resting on sand. Moreover, should the user wish to change the position of such a chair, for example, relative to the sun, the user must usually rise from the chair to manually change the position of the chair.

Accordingly, it is an object of the invention to provide an armless chair which is stable when in use.

It is another object of the invention to provide an armless chair which can be rotated by a user while seated in the chair.

It is another object of the invention to provide an inexpensive, lightweight, armless chair which is stable when used in sand.

It is another object of the invention to provide an armless sand chair which folds and stacks for ease of shipment and storage.

It is another object of the invention to provide a collapsible armless sand chair of simple construction.

Briefly, the invention provides a chair comprised of a seat frame which defines a first leg support and a back frame which is secured to the seat frame and which has one end defining a second leg support with a transverse portion having an intermediate section projecting away from the first leg portion.

The seat frame is constructed of a one-piece elongated member having a pair of bent parallel arms and a transverse portion which connects the arms. In this respect, the elongated member is of generally U-shape. In like manner, the back frame includes a one-piece elongated member having a pair of parallel arms with the transverse portion thereof connecting the parallel arms. Again, the elongated member of the back frame forms a U-shape.

The chair also has hinge means which hingedly secure the frames to each other for movement of the back frame between a raised upright position and a lowered folded position relative to the seat frame. Each hinge means includes a pair of arc-shaped hinge plates which are secured to an arm of the seat frame and an arm of the back frame in a manner to permit the arms of the back frame to abut the arms of the seat frame in the upright position. In this manner, the amount of movement of the back frame can be limited relative to the seat frame.

The intermediate section of the transverse portion of the back frame is arcuately bent in a manner so as to provide stability to the chair when in the upright position. For example, when the chair is opened and placed on a support surface, for example on sand, the two transverse portions of the seat and back frame are firmly seated on the sand. In addition, the projecting portion of the back frame provides a wider effective base at the rear of the chair. For example, if the user leans back, rather than having the chair pivot about a single axis parallel to the front leg portion, the bent projecting portion digs into the sand over a curvilinear axis.

The projecting portion of the back frame is also disposed at a small upwardly directed angle to the common support plane. This allows the user to lean back in the chair until the front leg support leaves the support surface. At this time, the user may rotate the chair to the left or to the right without having to move out of the chair. This permits the user to shift the chair, for example, to follow the path of the sun during daylight hours. In addition, when the chair is placed on a flat hard ground surface, the upward bent of the projecting portion of the back frame precludes this portion from contacting the ground surface first. This characteristic ensures that the back frame is properly angled for seating of an occupant.

These and other objects and advantages of the invention will become more apparent from the following detailed description of the invention taken in conjunction with the accompanying drawings.

Figure 1:
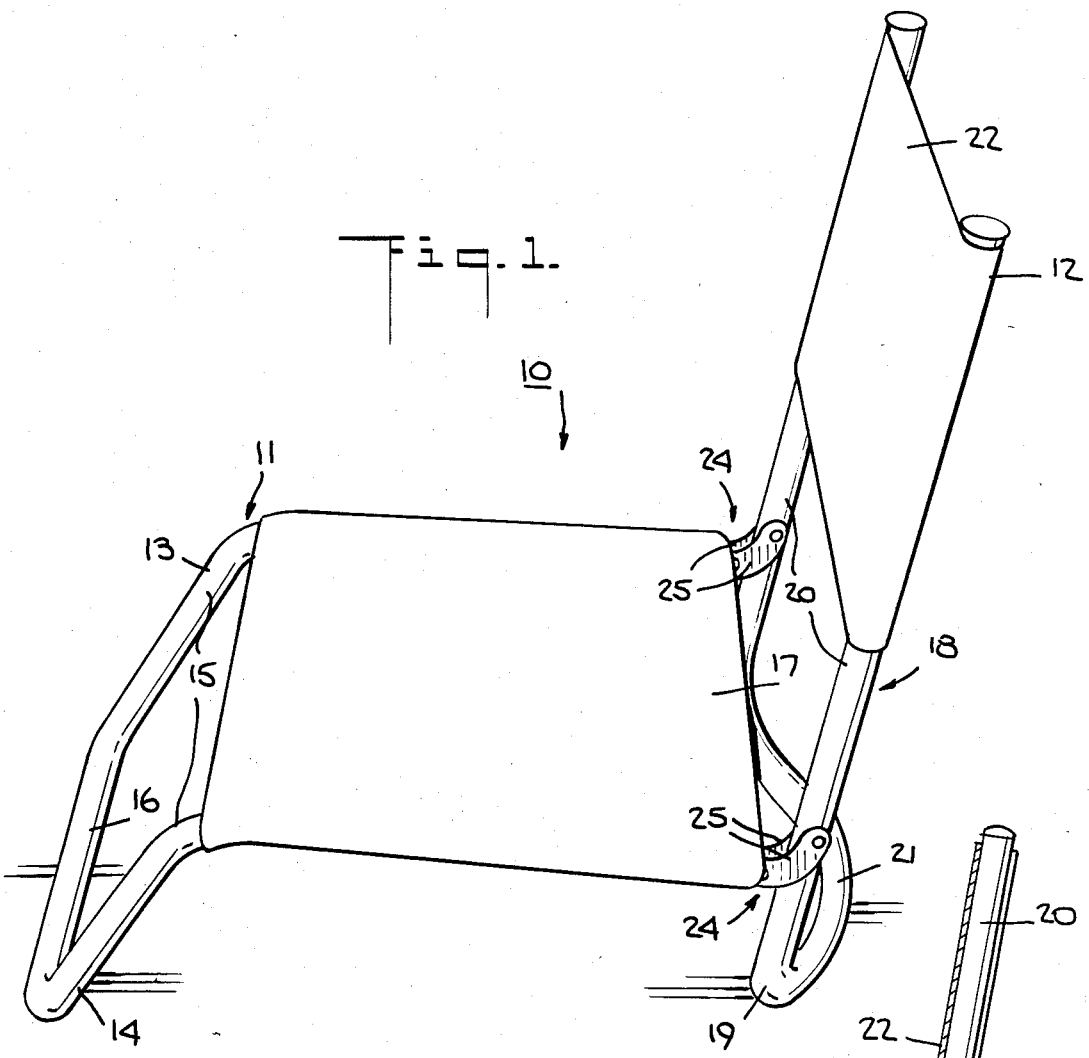
FIG. 1 shows a perspective view of a chair according to the invention upright position.

Referring to FIG. 1, the chair 10 is constructed with a seat frame 11 and a back frame 12. The seat frame 11 is formed of a one-piece hollow tubular member 13 which is bent into a U-shape to form a front leg support 14. As shown, the tubular member 13 has a pair of parallel arms 15 which are connected by a transverse portion or crossbar 16. The arms 15 are bent to define the front leg support 14 and support a seat 17 of suitable material which extends across the seat frame 11.

The back frame 12 is also formed of a one-piece hollow tubular member 18 which is bent into a U-shape to define a rear leg support 19. As shown, the member 18 has a pair of parallel arms 20 with a transverse portion or crossbar 21 connecting the arms 20. The crossbar 21 also has an intermediate section which projects away from the front leg support 14 and out of the plane of the back frame 12. For example, the projecting portion is of an arcuate shape which extends backward from the chair. For example, the projecting portion has a ram bend, i.e. a bend disposed on a radius of about twelve inches. Alternatively, the projecting portion may be formed of other shapes. By way of example, the projecting portion may be formed of a pair of straight end sections and a central curved section or may be formed of a bent cross-bar with a straight intermediate portion. In any event, the axis A of the projecting portion at the outermost point of projection P should be displaced from an axis B passing through the lower ends of the arms 20 by a distance X equal to about $3\frac{1}{2}$ inches.

Figure 2:
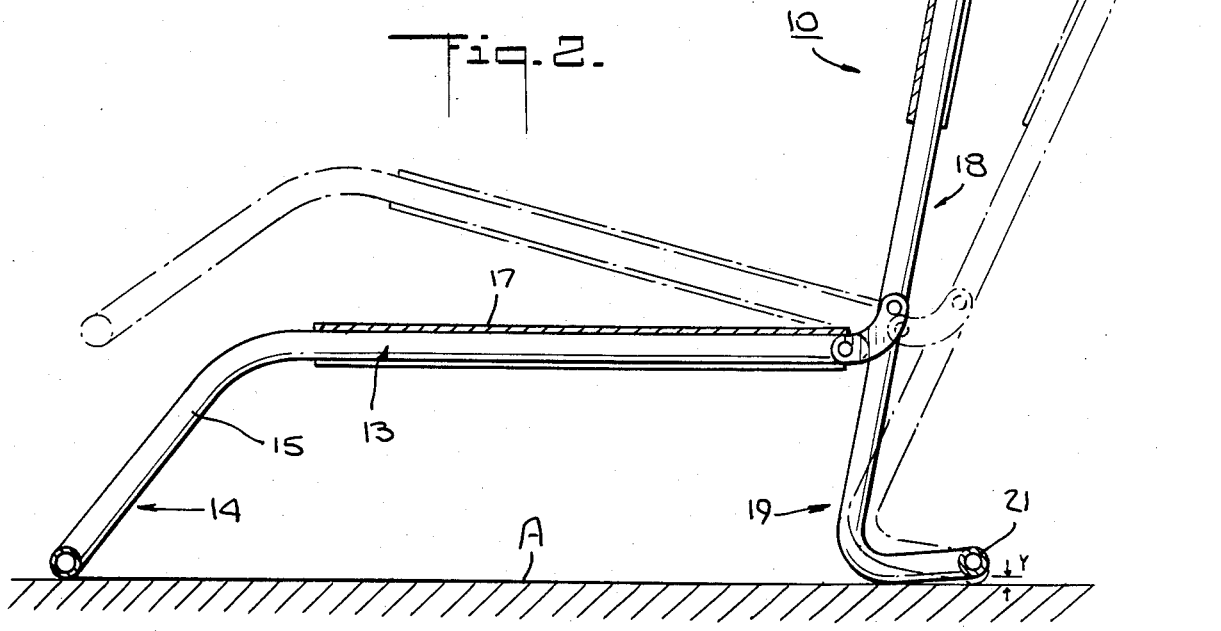
FIG. 2 shows a side view of the chair of FIG. 1.

Further, as indicated in FIG. 2, the intermediate section of the crossbar 21 is disposed at an angle to a support plane A which is common to the crossbar 16 of the front leg support 14. This angle should be sufficient to have the intermediate section raised a distance Y of about ⅛ inch from the support plane A at the outermost point of projection P. This upward bent in the projecting portion of the back frame 12 is particularly useful on hard ground surfaces, such as at poolside. That is, the upward bent precludes the crossbar 21 from contacting the support plane A first. This precludes tilting of the chair forwardly and permits the back frame 12 to be properly angled backwardly to receive an occupant.

Figure 4:
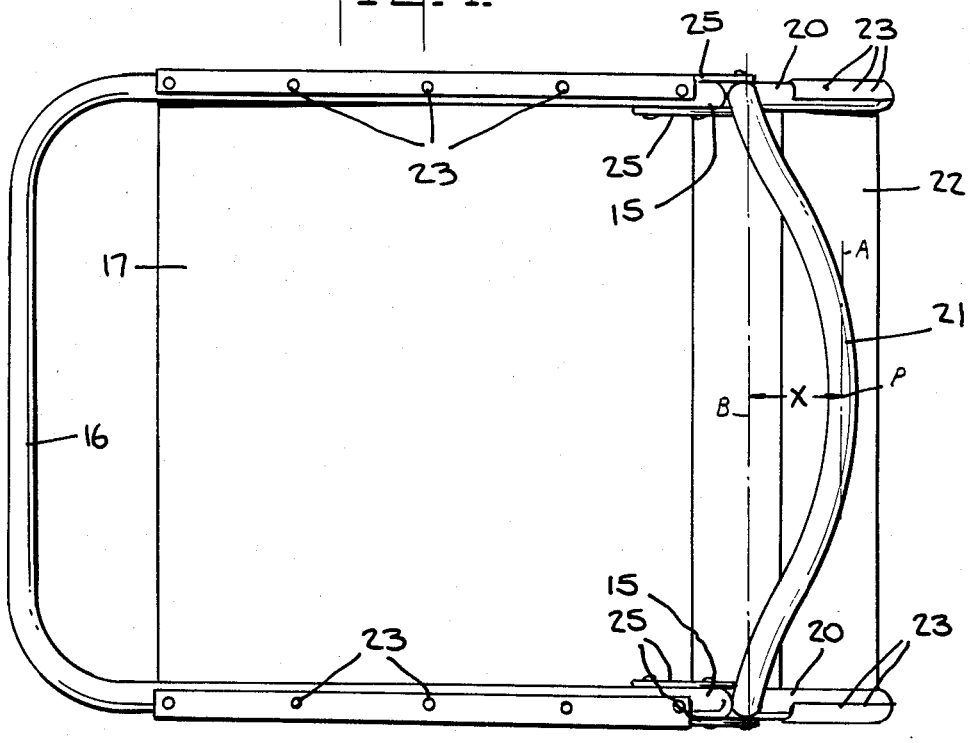
FIG. 4 shows a bottom view of the chair of FIG. 1.

A back 22 extends between the parallel arms 20 of the back frame 12 and, as the seat 17, may be of any suitable material such as a woven fabric, a web material, or the like. As shown in FIG. 4, the seat 17 and back 22 may be fastened to the parallel arms 15, 20, respectively, by fastening means such as rivets 23, or other means known to the art. The tubular members 13 and 18 may be of any suitable material, but are preferably of a strong, lightweight material such as aluminum.

As shown in FIG. 1, the seat frame 11 and the back frame 12 are hingedly connected by hinge means 24 to permit the back frame 12 to be pivoted between a raised upright position as shown in FIG. 1 to a lowered folded position over the seat frame 11 as shown in dotted line in FIG. 2. As shown, each hinge means 24 has a pair of arc-shaped hinge plates 25 fixedly secured, as by rivets, on opposite sides of one end of an arm 15 of the seat frame 11 and pivotally secured, as by a rivet, on opposite sides of an arm 20 of the back frame 12. These hinge plates 25 are shaped to permit the back frame arms 20 to abut the ends of the seat frame arms 15 and thus establish the upright position of the chair 10.

As shown in FIG. 2, the seat 17 and the back 22 are disposed at an obtuse angle with respect to one another in the upright position. This angle is determined in part by the angle between the curved crossbar 21 of the back frame 12 and the support plane A, and may be of any angle which provides proper pitch to the back 22 for user comfort.

Figure 3:
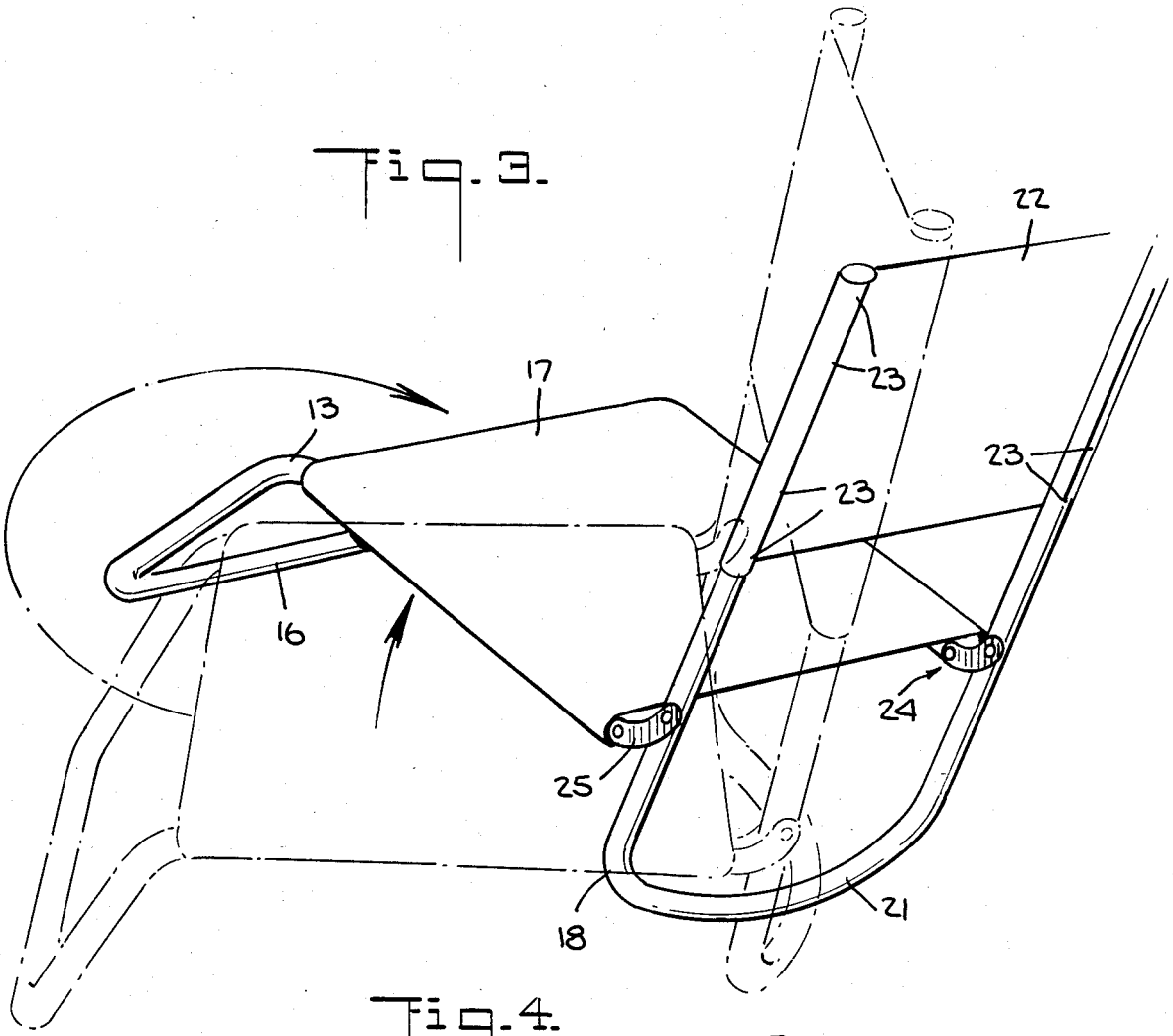
FIG. 3 shows a perspective view of the chair of FIG. 1 during rotation to the right.

Referring to FIG. 2 when in use, for example on a support of sand, the chair 10 may be tilted back by an occupant until the front leg support 14 leaves the sand. The upwardly angled projecting portion of the back frame 12 is thus rotated until coming into contact with the sand. When this position is reached, the chair 10 may be rotated to the right or left as indicated in FIG. 3. Ease of rotation is enhanced by the arcuate shape of the crossbar 21 of the back frame 12. Thus, for example, the user may easily shift position with respect to the movement of the sun without standing up and manually repositioning the chair.

As indicated in Page 1, the chair 10 is armless. Hence, when folded into a collapsed condition, the chair 10 occupies a minimum of space and can be easily stacked and transported.

When used on surfaces such as a sandy beach, the curvilinear crossbar 21 of the backframe provides a relatively stable leg support for the chair 10. In particular, with an occupant seated within the chair 10, the rear leg support 19 will penetrate the sand while spreading out the loading over the curved crossbar 21 rather than along a straight line as is the case with the cross bar 16 of the front leg support 14. Should the occupant lean back in the chair 10, the curved cross-bar 21 imparts further stability since the pivot axis moves rearwardly from an imaginary axis passing through the arms 20 of the back frame 12 toward the rearmost point of the crossbar 21.

Further, should repositioning of the chair 10 be desired, an occupant need only lean back a sufficient distance to raise the front leg support 14 and pivot on the curved crossbar 21 of the rear leg support 19.

Should the chair 10 be used on solid surfaces such as a concrete apron about poolside, similar use may be made of the chair. However, in this case, a substantial portion of the curved cross-bar 21 would be out of contact with the concrete support surface, as indicated in FIG. 2. However, stability is imparted to the chair 10 should the occupant lean backwardly since the curved cross-bar 21 would be brought into engagement with the concrete support service.

The invention thus provides an inexpensive chair which can be used, for example at beaches and like areas. Further, the invention provides a collapsible chair which can be folded and stacked for ease of shipment and storage.

Still further, the invention provides a chair which can be made of relatively simple parts and which can be assembled in a relatively rapid manner.

What is claimed is:

1. An armless chair comprising a seat frame defining a first leg support; and a back frame secured to said seat frame in an upright position, said back frame defining a second leg support including a transverse portion at a lower end having an intermediate section projecting away from said first leg in said upright position.

2. An armless chair as set forth in claim 1 which further comprises a pair of hinges oppositely disposed and fixed to said seat frame and pivotally secured to said back frame to pivotally connect said back frame to said seat frame for movement between said upright position and a lowered folded position relative to said seat frame.

3. An armless chair as set forth in claim 2 which further comprises a seat extending across said seat frame and a back extending across said back frame, said back being disposed at an obtuse angle to said seat in said raised upright position and being superimposed upon said seat when in said lowered folded position.

4. An armless chair as set forth in claim 1 wherein said projecting portion is angled upwardly in said upright position.

5. A collapsible chair comprising a skeletal seat frame having a bent portion at one end defining a first leg support; and a skeletal back frame hingedly secured to said seat frame at an opposite end of said seat frame to move between a raised upright position and a lowered folded position relative to said seat frame, said back frame having one end defining a second leg support with a transverse portion having an intermediate section projecting away from said first leg support in said raised position.

6. A collapsible chair as set forth in claim 5 wherein said seat frame includes a one-piece elongated member having a pair of bent parallel arms and a transverse portion connecting said arms and said back frame includes a one-piece elongated member having a pair of parallel arms with said transverse portion thereof connecting said parallel arms thereof.

7. A collapsible chair as set forth in claim 6 wherein said transverse portion of said seat frame is horizontally disposed relative to a common support plane in said upright position and said transverse portion of said back frame is disposed at an angle to said common support plane in said upright position.

8. A collapsible chair as set forth in claim 6 which further comprises hinge means secured to each arm of said seat frame and to a respective arm of said back frame to hingedly secure said frames together.

9. A collapsible chair as set forth in claim 8 wherein each hinge means includes a pair of arc-shaped hinge plates secured to said respective arms to permit said arms of said back frame to abut said arms of said seat frame in said upright position.

10. A collapsible chair as set forth in claim 5 wherein said intermediate section is arcuately bent.

11. A collapsible chair as set forth in claim 8 wherein said transverse portion of said seat frame is horizontally disposed relative to a common support plane in said upright position and said transverse portion of said back frame is disposed at an angle to said common support plane in said upright position.

12. A collapsible chair as set forth in claim 5, which further comprises a pair of hinges oppositely disposed and fixed to said seat frame and pivotally secured to said back frame to pivotally connect said back frame to said seat frame.

13. A collapsible chair as set forth in claim 5 which further comprises a seat extending across said seat frame and a back extending across said back frame, said back being disposed at an obtuse angle to said seat when in said upright position and being superimposed on said seat when in said folded position.

14. A collapsible chair comprising a one piece seat frame defining a first leg support; and a one piece back frame secured to said seat frame and having one end defining a second leg support with a transverse portion having an intermediate section projecting away from said first leg portion.

15. A collapsible chair as set forth in claim 14 wherein said seat frame includes a one-piece elongated member having a pair of bent parallel arms and a transverse portion connecting said arms and said back frame includes a one-piece elongated member having a pair of parallel arms with said transverse portion thereof connecting said parallel arms thereof.

16. A chair as set forth in claim 15 wherein said transverse portion of said seat frame is horizontally disposed relative to a common support plane and said transverse portion of said back frame is disposed at an angle to said common support plane.

17. A chair as set forth in claim 15 which further comprises a seat extending across said seat frame and a back extending across said back frame.

18. A chair as set forth in claim 14 which further comprises hinge means hingedly securing said frames to each other for movement of said back frame between a raised upright position and a lowered folded position relative to said seat frame.

19. An armless chair comprising a seat frame defining a first leg support; and a one piece elongated member forming a back frame secured to said seat frame in an upright position, said member defining a rear leg support including a pair of parallel arms and a transverse portion connecting said arms at a lower end, said transverse portion having an intermediate section forming an arcuate bend and projecting away from said first leg in said upright position.

20. An armless chair as set forth in claim 19 which further comprises a pair of hinges oppositely disposed and fixed to said seat frame and pivotally secured to said back frame to pivotally connect said back frame to said seat frame for movement between said upright position and a lowered folded position.

21. An armless chair as set forth in claim 19 wherein said projecting portion is angled upwardly in said upright position.

22. A collapsible chair comprising a seat frame defining a first leg support; and a back frame secured to said seat frame and having one end defining a second leg support with a transverse portion having an arculately bent intermediate section projecting away from said first leg portion.

* * * * *

UNITED STATES PATENT AND TRADEMARK OFFICE

CERTIFICATE OF CORRECTION

PATENT NO. : 4,541,666

DATED : September 17, 1985

INVENTOR(S) : Robert D. Vanderminden

It is certified that error appears in the above-identified patent and that said Letters Patent is hereby corrected as shown below:

Page 1 add "Assigned to: THE TELESCOPE FOLDING FURNITURE COMPANY INC., GRANVILLE, NEW YORK"

Column 2, line 30 change "invention upright" to -invention in an upright-

Column 4, line 11 change "service" to -surface-

Column 6, line 39 change "arculately" to -arcuately-

Column 2, line 20 change "bent" to -bend-

Column 3, line 2 change "bent" to -bend-

Column 3, line 5 change "bent" to -bend-

Signed and Sealed this

*Eighth* Day of *April 1986*

[SEAL]

*Attest:*

DONALD J. QUIGG

*Attesting Officer*

*Commissioner of Patents and Trademarks*